United States Patent [19]

Diekmann

[11] Patent Number: 5,026,588

[45] Date of Patent: Jun. 25, 1991

[54] EDGE PROTECTING FRAME FOR PLATE-SHAPED STRUCTURAL ELEMENTS

[75] Inventor: Bernd Diekmann, Halle, Fed. Rep. of Germany

[73] Assignee: Schüco International GmbH & Co., Bielefeld, Fed. Rep. of Germany

[21] Appl. No.: 462,800

[22] Filed: Jan. 10, 1990

[30] Foreign Application Priority Data

Jan. 11, 1989 [DE] Fed. Rep. of Germany ..... 3900565

[51] Int. Cl.[5] ..... B32B 3/06

[52] U.S. Cl. ..... 428/100; 52/717.1; 248/345.1; 428/120; 428/192

[58] Field of Search ..... 428/99, 120, 192, 100; 248/345.1; 52/717.1

[56] References Cited

U.S. PATENT DOCUMENTS 3,235,040 2/1966 Ellis ..... 428/192 X
3,590,754 7/1971 Jakobsen ..... 428/192 X
4,370,373 1/1983 Janicz ..... 428/192 X
4,810,550 3/1989 Gasser ..... 428/120 X

FOREIGN PATENT DOCUMENTS 2188006 9/1987 United Kingdom ..... 428/192

*Primary Examiner*—Henry F. Epstein
*Attorney, Agent, or Firm*—Michael J. Striker

[57] ABSTRACT

An edge protecting frame for plate-shaped structural elements comprises a plurality of edge protecting strips abutting against one another in abutment regions, a plurality of corner connectors each connecting two neighboring ones of the edge protecting strips in the abutment regions, a plurality of harpoon webs engageable in the grooves of a structural part, and a plurality of insertion profile portions each having one of the harpoon webs and form-lockingly connected with a respective one of the edge protecting strips.

15 Claims, 2 Drawing Sheets

EDGE PROTECTING FRAME FOR PLATE-SHAPED STRUCTURAL ELEMENTS

BACKGROUND OF THE INVENTION

The present invention relates to an edge protecting frame for plate-shaped structural elements.

More particularly, it relates to such an edge protecting frame which is composed of several edge protecting strips connected in the abutment region by corner connectors and provided with harpoon webs engageable in grooves of the structural elements to be fixed. The edge protecting frames of the above mentioned type are used for protecting the peripheral end edges of the structural elements or the edges of the visible sides. In the latter case the frame are identified as blind or cover frames. The plate-shaped structural elements can be for example furniture doors, kitchen work plates, cover plates for kitchen electrical devices and other structural elements.

In the known edge protecting frames, the harpoon webs are formed integrally on the edge protecting strips. Conventionally, the end side of each edge protecting strip is cut to form a bevel. This results in very high manufacturing expenses. Moreover the material costs especially in the event of high-grade materials are very high as well.

SUMMARY OF THE INVENTION

Accordingly, it is an object of the present invention to provide an edge frame which avoids the disadvantages of the prior art.

More particularly, it is an object of the present invention to provide an edge protecting frame in which the expenses both for the material and for the manufacture are maintained as low as possible, even when the edge protecting strips are composed of a high-grade material.

In keeping with these objects and with others which will become apparent hereinafter, one feature of the present invention resides, briefly stated, in an edge protecting frame in which each edge protecting strip is connected in a form-locking manner with at least one insertion profile strip having the harpoon web.

When the edge protecting frame is designed in accordance with the present invention it becomes possible to considerably reduce the cross-section of the edge protecting strips, so as to maintain the material costs at a bearable level even when the edge protecting strips are composed of high-grade materials. The insertion profile strips which perform the function of a holding strip can be produced of an extremely inexpensive material, since they are invisible.

In accordance with a further embodiment of the present invention, each edge protecting strip can be formed as a profile rail composed of a light metal, for example, aluminum, while the insertion profile strips can be formed as profile rails composed for example of synthetic plastic material. In addition to the economy of light metal, in this embodiment the edge protecting strip which includes the harpoon web and composed of light metal is considerably greater than in the first-mentioned embodiment.

An especially small cross-section for the edge protecting strips, as well as a simple shape of the form-locking connection between the protecting strip and the insertion profile strip is achieved when, in accordance with a further embodiment of the present invention, each edge protecting strip is provided at its side facing toward the structural element with a groove having an undercut. The insertion profile strips have a substantially T-shaped cross-section with a central web forming the harpoon web, and a flat, rectangular transverse web engageable in the groove of the edge protecting strip.

The insertion profile strip can extend substantially over the whole length of each of the edge protecting strips. The length however must not be so great that the harpoon webs of two insertion profile strips abut against one another in the corner region. For providing further saving of the material, it is advantageous when each edge protecting strip cooperates with several insertion profile portions formed so that the individual length is substantially smaller than the length of the edge protecting strip. Also, the total length obtained from the individual portions is substantially smaller than the length of the edge protecting strip. Advantageously, the distances between the individual portions are uniform.

The expenses for the manufacture for an edge protecting frame are further reduced, when each corner connector connects two edge connecting strips arranged at an angle relative to one another, and each edge connector has connecting pins engageable in the grooves of the edge protecting strips and a central part between the pins.

The connecting pins can be formed congruently to the grooves, while the central part can be formed congruently to the edge protecting strips. With this embodiment, the edge protecting strips produced from a single rod can be assembled into the edge protecting frame without further working.

The insertion profile strips or the insertion profile portions can be cut from a single strand. The insertion profile strips can be formed preferably as extruded profiles, while the edge protecting strips can be formed as extrusion molded profiles.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
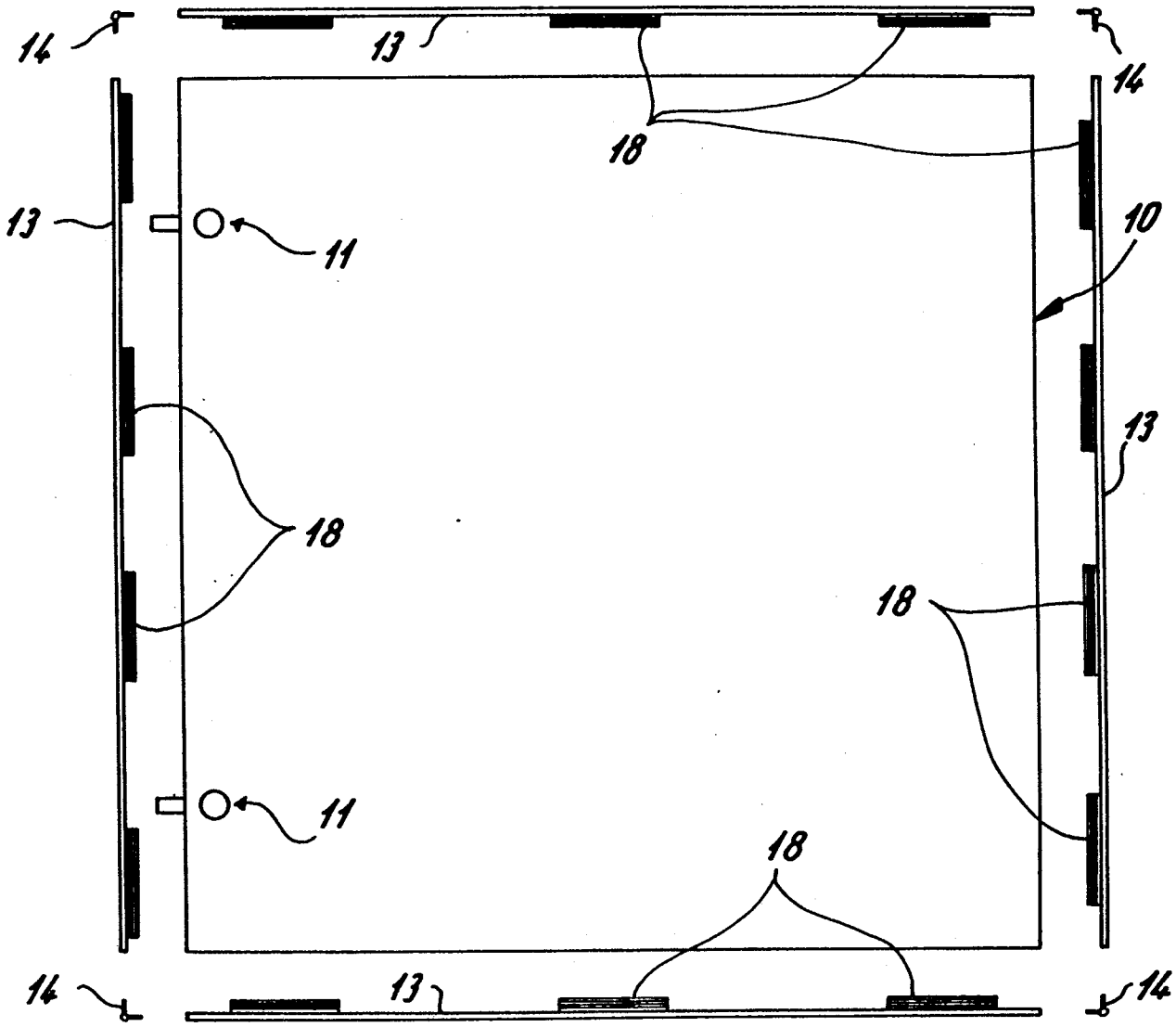
FIG. 1 is a plan view of a structural element to be provided with an edge protecting frame in accordance with the present invention, and the edge protecting frame in a disassembled condition.

A plate-shaped structural element shown in FIG. 1 is identified with reference numeral 10. The structural element here is a furniture door, which is pivotally connectable with a furniture body by means of a hinge 11. The end surfaces of the structural elements 10 are covered with an edge protecting frame 12.

The edge protecting frame 12 has four edge protecting strips 13 and four corner connectors 14 provided at the points of abutment of the edge protecting strips 13. Each edge protecting strip 13 is composed of an aluminum profile produced by extrusion. The visible outer sides are surface treated in a not shown manner. In the shown example the visible surfaces are provided with structures.

Each of the edge protecting strips 13 at its abutment surface facing toward the structural element 10 has a groove 15 which extends over its whole length. The groove 15 is undercut at its both outer sides. The undercuts are formed by two webs 16 which extend in one plane and are directed toward one another. Thereby each edge protecting strip 13 is provided with a throughgoing slot on its abutment side.

Before the edge protecting strips 13 are assembled together to form the edge protecting frame 12, several insertion profile portions 17 are inserted in the groove 15 of each edge protecting strip 13. In the shown example each insertion profile portion has a T-shaped cross-section. It is provided with a central web 18 which extends perpendicularly to the plane of the edge protecting strip 13 and is formed as a harpoon web. It also has a transverse web 19 which is insertable in the groove 15. Each groove 15 and each transverse web 19 are formed so that the insertion is required with a low force consumption. Thereby during the movement of the edge protecting strip 13 the position of the insertion profile portion 17 shown in FIG. 1 is maintained. The central webs 18 are pressed in a known manner into the grooves of the structural element 10. The insertion profile portions are formed as extruded synthetic plastic profiles. When the insertion profile portions 17 are inserted in the grooves 15 of the edge protecting strips 16, the edge protecting frame 12 is assembled.

Figure 3:
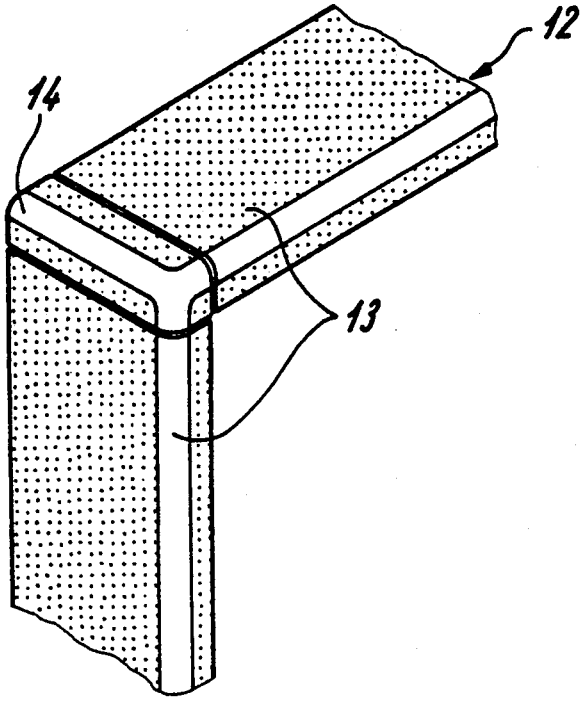
FIG. 3 is a perspective view of a corner of the edge protecting frame in accordance with the present invention in assembled condition.
Figure 2:
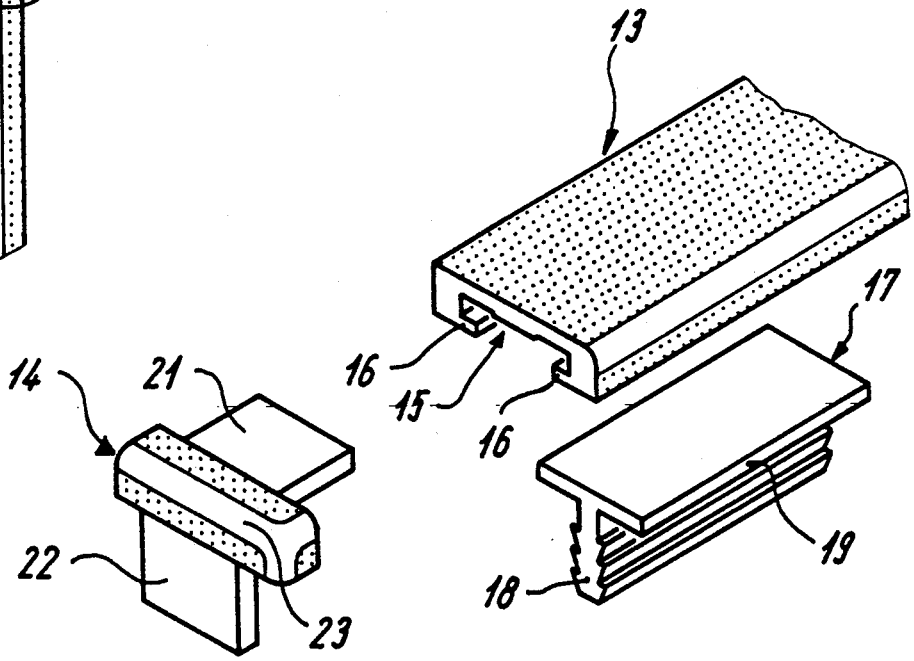
FIG. 2 is an explosion view of a corner of an edge protecting frame in accordance with the present invention.
Figure 2:
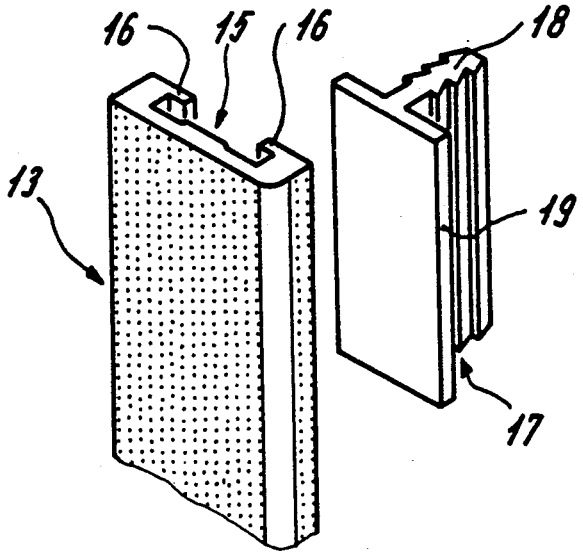

As can be seen from FIG. 3, a connector is located in the corner region. In the shown example, the connector includes two connecting pins 21 and 22 which extend perpendicularly relative to one another and a central part 23. The cross-section of each connecting pin 21, 22 corresponds to the cross-section of the groove 15, so that it is insertable in the groove 15 under the action of slight application of force. The outer contour of the central part 23 corresponds to the outer contour of the edge protecting strip 13.

As can be seen from the drawings, the cross-section of the edge protecting strips 13 is relatively small, so that only low high-grade material is required. Moreover, the edge protecting frame 12 can be assembled in extremely simple manner and can be utilized for producing simple machines of conventional type. The edge protecting strips 13 and the insertion profile portions 17 are produced by cutting from a strand. A further post-working is normally not required. The edge protecting strips 13 can be also have a non-uniform cross-section. In a not shown manner, it is also possible instead of several insertion profile portions, to use a single insertion profile strip 17. The length must be however so great that the harpoon webs or the central webs 18 do not abut against one another in the corner region.

In the shown embodiment, the edge protecting frame is designed so that the peripheral end surfaces of the structural part 10 are completely covered. With a respective design especially of the corner connector 14, also a blind frame or a cover frame can be assembled for covering the edge regions of a structural element 10.

The insertion profile strips or the insertion profile portions can also be composed of a light metal, for example aluminum. A substantial cost factor is the surface treatment of the edge protecting frame in question. When the insertion profile strips are composed of aluminum, a surface treatment is required only for the edge protecting strips. Since the surface treatment is substantially reduced, an edge protecting frame can be produced in an especially economical manner. It should be taken into consideration that the cost fraction for the surface treatment, amounts to approximately 50%. With the untreated insertion profile strips, this cost is significantly reduced, as can be recognized from the consideration of the presented example. It suffices when the insertion profile pieces are inserted in the edge protecting strip at certain distances, so that the material fraction for the insertion profile pieces is relatively low.

It will be understood that each of the elements described above, or two or more together, may also find a useful application in other types of constructions differing from the types described above.

While the invention has been illustrated and described as embodied in an edge protecting frame, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An edge protecting frame for plate-shaped structural elements, comprising a plurality of edge protecting strips abutting against one another in abutment regions; a plurality of corner connectors each connected with two neighboring ones of said edge protecting strips in said abutment regions so as to connect said two neighboring edge protecting strip with one another; a plurality of harpoon webs engageable in the grooves of a structural part; and a plurality of insertion profile portions each having one of said harpoon webs and form-lockingly connected with a respective one of said edge protecting strips.

2. An edge protecting frame as defined in claim 1, wherein each of said edge protecting strips is formed as a profile rail composed of a light metal.

3. An edge protecting frame as defined in claim 2, wherein each of said insertion profile portions is formed as a profile rail composed of synthetic plastic material.

4. An edge protecting frame as defined in claim 1, wherein each edge protecting strip has a side facing toward a structural element and is provided at said side with a groove having undercuts.

5. An edge protecting frame as defined in claim 4, wherein each of said insertion profile portions has a T-shaped cross-section and includes a central web which forms said harpoon web, and a flat rectangular portion engageable in said groove of a respective one of said edge protecting strips.

6. An edge protecting frame as defined in claim 1, wherein each of said insertion profile portions extends substantially over the whole length of each of said edge protecting strips.

7. An edge protecting frame as defined in claim 1, wherein said insertion profile portions are distributed over the length of one of said edge protecting strips at predetermined distances from one another.

8. An edge protecting frame as defined in claim 7, wherein said insertion profile portions are distributed over the length of each of said edge protecting strips at uniform distances.

9. An edge protecting frame as defined in claim 1, wherein each of said corner connectors has two connecting pins insertable into said grooves of two neighboring ones of said edge protecting strips, and a central part provided between said connecting pins.

10. An edge protecting frame as defined in claim 9, wherein said connecting pins of each of said corner connectors are formed congruently to said grooves of said edge protecting strips, said central part of each of said corner connectors being formed congruently to said edge protecting strips.

11. An edge protecting frame as defined in claim 1, wherein each of said edge protecting strips is composed of an extrusion molded profile.

12. An edge protecting frame as defined in claim 11, wherein each of said insertion profile portions is composed of an extruded synthetic plastic profile.

13. An edge protecting frame as defined in claim 1, wherein each of said edge connectors is formed as an aluminum injection molded part.

14. An edge protecting frame as defined in claim 1, wherein each of said edge protecting strips is formed as a profile rail composed of a light metal.

15. An edge protecting frame as defined in claim 14, wherein each of said insertion profile portions is formed as a profile rail composed of a light metal.

* * * * *